US006149258A

United States Patent [19]

Kimura

[11] Patent Number: 6,149,258

[45] Date of Patent: Nov. 21, 2000

[54] INK JET PRINTING HEAD AND METHOD FOR DRIVING THE SAME

[75] Inventor: Shigeru Kimura, Tokyo, Japan

[73] Assignee: NEC Corporation, Tokyo, Japan

[21] Appl. No.: 08/576,438

[22] Filed: Dec. 21, 1995

[30] Foreign Application Priority Data

Dec. 27, 1994 [JP] Japan ..... 6-325694

[51] Int. Cl.[7] ..... B41J 2/01

[52] U.S. Cl. ..... 347/10; 347/70

[58] Field of Search ..... 347/70, 71, 72, 347/10, 11

[56] References Cited

U.S. PATENT DOCUMENTS 4,730,197 3/1988 Raman et al. ..... 346/140 R
5,495,270 2/1996 Barr et al. ..... 347/10

FOREIGN PATENT DOCUMENTS 59-98862 6/1984 Japan .
63-251241 10/1988 Japan .
1-101160 4/1989 Japan .
1-297258 11/1989 Japan .
3-213346 9/1991 Japan .

*Primary Examiner*—John Barlow
*Assistant Examiner*—Craig Hallacher
*Attorney, Agent, or Firm*—Sughrue, Mion, Zinn, Macpeak & Seas, PLLC

[57] ABSTRACT

An ink jet printing head includes a plurality of pressure chambers having a natural period T2 for propagation of a wave, and a plurality of piezoelectric elements having a natural period T1 for oscillation. T1 and T2 are selected such that T1=n·T2 or T2=n·T1 wherein n is a natural number. The driving voltage for the piezoelectric elements has a rise time T3 selected at T3=m·T2 wherein m is a natural number not lower than two if T1=2·T2, or selected at T3=m·T2 wherein m is a natural number if T2=n·T1. The rise time T3 may be selected at T3=n·T1 in the latter case. Both the rise time T3 and the voltage level V of the driving voltage are selected in a single printing head so that V/T3 is a constant for attaining a gray scale level printing. The rise time T3 thus selected provides stable ink droplets without satellite ink droplets degrading the printing quality.

7 Claims, 6 Drawing Sheets

DRIVING VOLTAGE
V

DISPLACEMENT OF
PIEZOELECTRIC ELEMENT

VELOCITY OF
PIEZOELECTRIC ELEMENT

VELOCITY OF INK
T2
t
T1 = T3
m = 2
n = 2

V
DRIVING VOLTAGE

DISPLACEMENT OF
PIEZOELECTRIC ELEMENT

VELOCITY OF
PIEZOELECTRIC ELEMENT

VELOCITY OF INK
T2
t
2T1 = T3
m = 4
n = 2 m = 1 n = 3

INK JET PRINTING HEAD AND METHOD FOR DRIVING THE SAME

BACKGROUND OF THE INVENTION (a) Field of the Invention

The present invention relates to an ink jet printing head and a method for driving the same. More specifically, it relates to an ink jet printing head for an ink jet printer having a piezoelectric element for converting an electric signal to mechanical energy levels and to a method for driving the ink jet printing head.

(b) Description of the Related Art

A non-impact printing system has attracted special interest lately because of its small noise and high-speed printing. Among other non-impact printing systems, an ink jet printing system, in which liquid ink droplets are discharged from a printing head and adheres to recording paper to thereby form characters or figures, has an advantage that high-speed printing is performed on plain paper without a special fixing process. Various types of ink jet printers using the ink jet printing system have been proposed and manufactured.

The ink jet printing systems are roughly categorized in three types including a continuous injection type, an impulse injection type (or on-demand type) and an electrostatic attraction type. Especially, the on-demand type is expected for practical use because of its advantages of a low ink consumption and a simple structure. The advantages may be attributed to the piezoelectric elements operated to discharge liquid ink droplets on each demand. Examples of the publications disclosing on-demand type ink jet printers or methods for driving the same includes Patent Publication Nos. 59(1984)-98862, 63(1988)-251241, 1(1989)-101160, 1(1989)-297258 and 3(1991)-213346.

Patent Publication No. 59-98862 describes a method for driving an ink jet printing head in which a plurality of driving pulses are supplied to piezoelectric elements synchronously with the natural period for oscillation of the ink head which is smaller than the minimum response period of the piezoelectric elements, to thereby change the number of ink molecules per ink droplet in accordance with requested gray scale levels, while maintaining the printing speed.

Patent Publication No. 63-251241 describes an ink jet printing head in which an ink droplet is first discharged from an orifice by rapidly reducing the volume of the ink chamber for pressurizing, then the volume of the ink chamber is increased slowly so that movement of the meniscus in the ink nozzle after discharge of the ink droplet is restricted within a predetermined amount and a limited speed. To attain this movement of the meniscus, the ink printing head has a signal modulating section for changing the time constant in a fall time of the driving pulses in accordance with the voltage level of the driving pulses applied to the piezoelectric elements, thereby controlling the time period for recovering the ink chamber to the initial state. It is described that this type of ink head printer has advantages of superior frequency response, stable discharge, fine gradation levels and imaging accuracy.

Patent Publication No. 1-101160 describes an on-demand type ink jet printer in which a supplementary pulse is applied to piezoelectric elements after a printing pulse is supplied to the piezoelectric elements, the supplementary pulse having a delay time in accordance with the gray scale levels to thereby operate the printing head in a gradation sequence in accordance with the information supplied thereto.

Patent Publication No. 1-297258 describes a method for driving an ink jet printing head in which the electric signal supplied to the piezoelectric elements includes a first pulse for discharging ink droplets from the ink nozzle and a second pulse having a waveform substantially equal to the waveform of the first pulse and a delay time of 2l/c from the first pulse, wherein l is the length of the portion of the printing head which corresponds to the length of the piezoelectric elements and reflects pressure wave, and wherein c is the sound velocity along the ink inside the ink chamber. The method also changes the fall time of the driving pulses dependently of the ink temperature detected by a thermal sensor. The method has an advantage that satellite ink droplets are reduced. In general, the satellite droplet degrades the imaging quality due to the difference in landing position of the ink, which is caused by the difference in velocity between the satellite droplets and the main droplets.

Patent Publication No. 3-213346 describes an ink jet printer having a changing means for changing the amount of discharged ink dependently of the driving timing of the piezoelectric element and a delay means for delaying the driving timing of the piezoelectric elements from the timing of the operation of the changing means, wherein the mount of the discharged ink is changed dependently of the delay time by the delay means. The ink jet printer has an advantage in obtaining a uniform printing in a gradation sequence or gray scale level printing.

The ink jet printing system is expected to attain a full-color image by changing the size or diameter of the discharged ink droplets in a gradation sequence printing. Examples of such printing systems so far proposed include one having means for changing the driving voltage applied to the piezoelectric elements, one having different ink chambers for receiving inks having different concentrations, one having a plurality of ink nozzles having different diameters for a gradation sequence printing, etc.

Those proposed ink Jet printing systems as described above, however, do not always provide a sufficient frequency response, stable discharge of the ink droplets, excellent image in gradation sequence, and accurate imaging positions. For example, the method controlling the driving voltage of the piezoelectric elements for a gradation sequence printing has a problem that the velocity of the ink droplets changes depend on the voltage levels so that landing positions of the ink droplets change accordingly, resulting in degradation in the imaging quality.

Further, the rise in the voltage level in the driving voltage generates satellite droplets which have low velocities and degrade the printing quality. The fourth publication as mentioned above describes the technique for reducing the satellite droplets. However, it is difficult to entirely remove the satellite droplets even by this technique.

The ink jet printer in which different ink concentrations provide different gray scale levels or in which different nozzles having different diameters provide different gray scale levels also have the disadvantages that the printer has a large dimension and requires a large cost for production.

SUMMARY OF THE INVENTION

An object of the present invention is to provide an ink jet printer in which ink droplets discharged from a nozzle have substantially a uniform velocity to provide an excellent printing quality even in a gray scale level printing.

Another object of the present invention is to provide a method for driving the ink jet printing head in the ink jet printer as mentioned above.

An ink jet printing head according to the present invention comprises an ink chamber, at least one pressure chamber having an inlet communicated with the ink chamber and a nozzle for discharging ink droplets therethrough, a piezoelectric element, disposed for each pressure chamber, for pressurizing the pressure chamber upon application of a driving voltage, the piezoelectric element having a natural period T1 for oscillation, the pressure chamber having a natural period T2 for propagation of wave, wherein T1 and T2 are selected so as to satisfy the following equation:

$$T1=n\cdot T2$$

or $$T2=n\cdot T1$$

wherein n is a natural number.

In a preferred embodiment of the ink jet printing head according to the present invention, T1 and T2 are selected such that T1=2·T2 or T2=n·T1 wherein n is a natural number not lower than two.

A method according to the present invention is directed to an ink jet printing head as described above. The method includes the steps of applying a driving voltage to the piezoelectric element, the driving voltage having a rise, time T3 satisfying the relationship that T3=m·T1 if T2=n·T1 or that T3=m·T2 if T1=n·T2, wherein m is a common multiple of n.

In a preferred embodiment of the present invention, T1 and T2 are selected such that T1=2·T2, so that T3 is selected at T3=m·T2 wherein m is an even number.

In another preferred embodiment, T1 and T2 are selected such that T2=n·T1 wherein n is not lower than two.

In accordance with the present invention, residual oscillation does not generate in the pressure chamber due to resonance of the piezoelectric elements. Accordingly, the printing head provides a high-quality image based on stable ink droplets including substantially no satellite droplets.

Further, in one embodiment of the present invention, it is possible that the maximum velocity of the piezoelectric elements does not depend on the rise time of the driving voltage applied thereto. This enables ink droplets to have a uniform velocity even when the displacement of the piezoelectric elements and the size of the ink droplets are changed dependently of the rise time of the driving voltage. In this case, the landing positions of the ink droplets reside within a small area so that stable printing image can be obtained in a gray scale level printing.

BRIEF DESCRIPTION OF THE DRAWINGS

The above and other objects, as well as features and advantages of the present invention will be more apparent from the following description, referring to the accompanying drawings in which.

DESCRIPTION OF THE PREFERRED EMBODIMENTS

Now, the present invention will be described in more detail by way of the various embodiments thereof and with reference to the annexed drawings.

Figure 1:
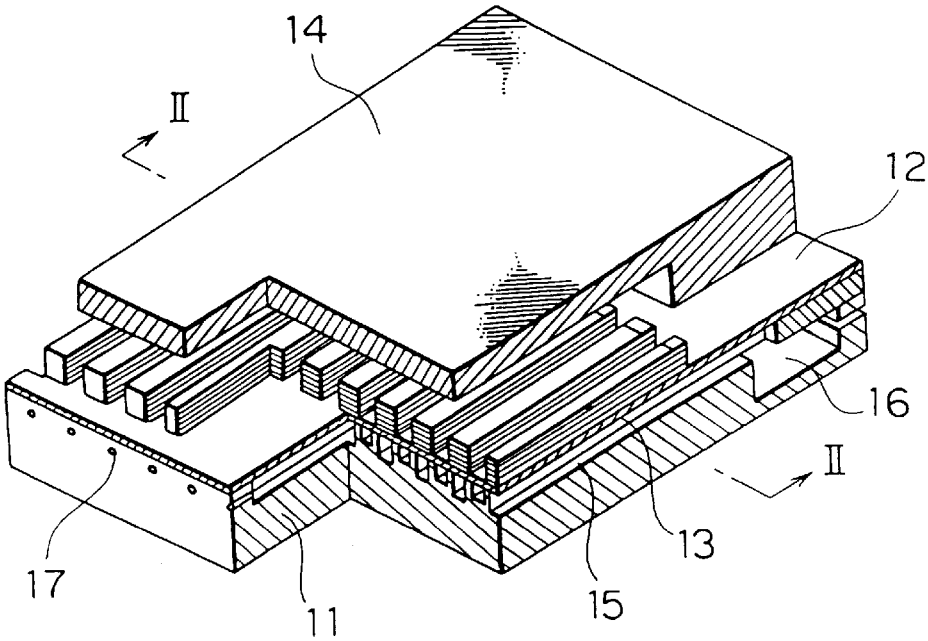
FIG. 1 is a perspective view, including a partial cross-section, of an ink Jet printing head according to an embodiment of the present invention.
Figure 2:
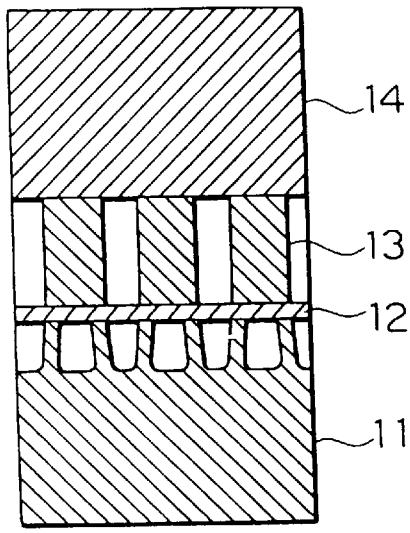
FIG. 2 is a cross-sectional view of the ink Jet printing head taken along line II—II in FIG. 1.

Referring to FIGS. 1 and 2, an ink jet printing head according to an embodiment of the present invention has a bottom plate 11 defining therein a plurality of pressure chambers 15 and an ink chamber 16 communicated thereto, a seal plate 12 mounted on the bottom plate 11 and sealing the pressure chambers 15 and the ink chamber 16, a piezoelectric element 13 disposed for each of the pressure chambers 15, and a top plate 14 for fixing the seal plate 12 and the piezoelectric elements 13 to the bottom plate 11.

Each of the pressure chambers 15 has an inlet communicated with the common ink chamber 16 for receiving ink therefrom and an outlet formed as an ink nozzle 17 for discharging ink droplets therethrough. Each of the piezoelectric elements 13 is connected to a signal line (not shown) for applying a driving voltage thereto. Further, each of the piezoelectric elements 13 is interposed between the top plate 14 and the seal plate 12 for thrusting the portion of the seal plate 12 adjacent to the each of the piezoelectric elements 13 towards the corresponding pressure chamber 15 upon application of the driving voltage. The pressure chamber 15 is reduced in volume by the deflection of the seal plate 12 and thereby discharges the ink inside the pressure chamber 15 through the nozzle 17 as ink droplets.

Here, for the sake of understanding the present invention, comparative examples of the driving voltage for the piezoelectric elements and function thereof will be described first.

Figure 3A:
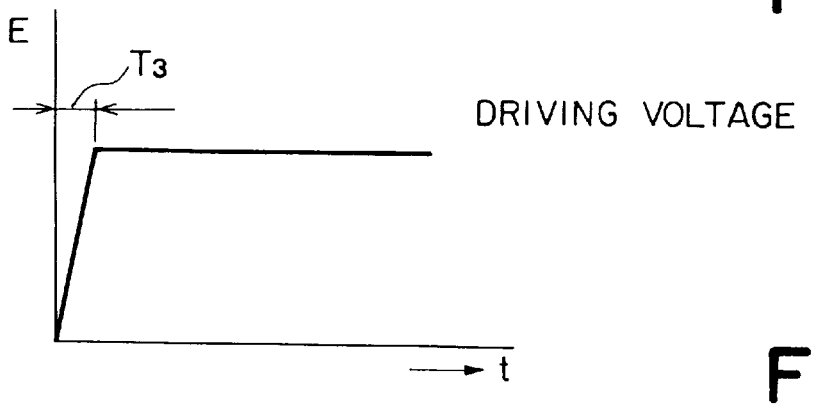
FIGS. 3A, 3B and 3C are first comparative examples of timing charts of a supply voltage, displacement of piezoelectric element, and velocity thereof, respectively, in an ink Jet printing head.
Figure 3B:
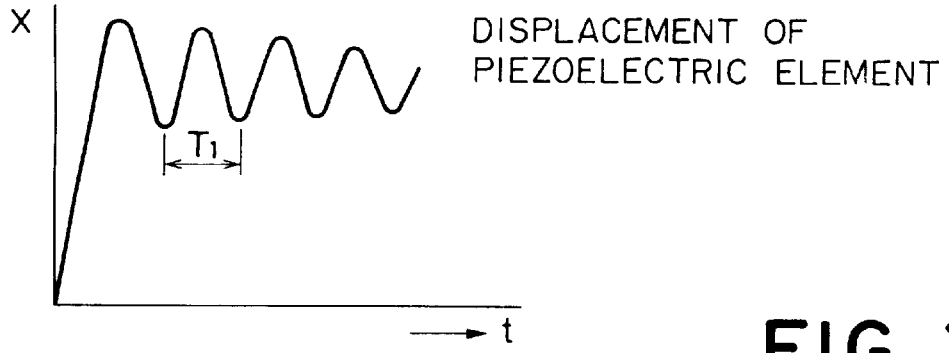
Figure 3C:
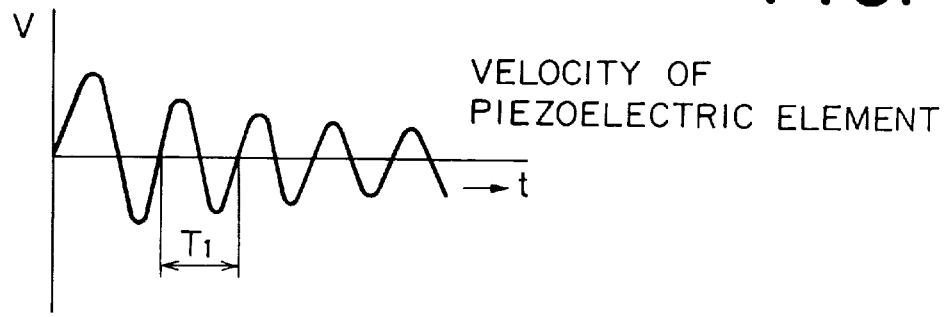

Referring to FIGS. 3A, 3B and 3C, there is shown a first comparative example of a driving voltage, and displacement and velocity of the piezoelectric elements driven by the driving voltage. If the driving voltage, as shown in FIG. 3A, has a rise time T3 selected independently of the natural period T1 of the piezoelectric elements, namely, if T3≠nT1 wherein n is a natural number, the displacement and velocity of the piezoelectric elements oscillate at the natural period T1 for oscillation of the piezoelectric elements and at an amplitude which decreases with time, as shown in FIGS. 3B and 3C. The oscillation of the velocity of the piezoelectric elements at the decreasing amplitude generates a plurality of satellite ink droplets to thereby degrade the imaging quality.

Figure 4A:
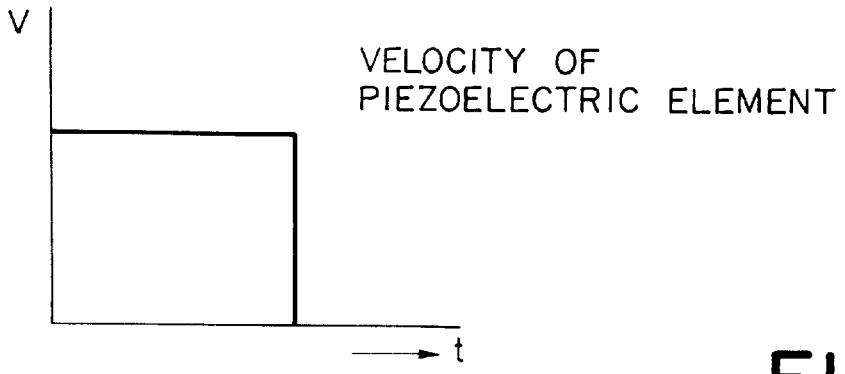
FIGS. 4A, 4B and 4C are second comparative examples of timing charts of a velocity of the piezoelectric elements, displacement thereof and velocity of the ink molecules in the pressure chamber, respectively, in an ink jet printing head.
Figure 4B:
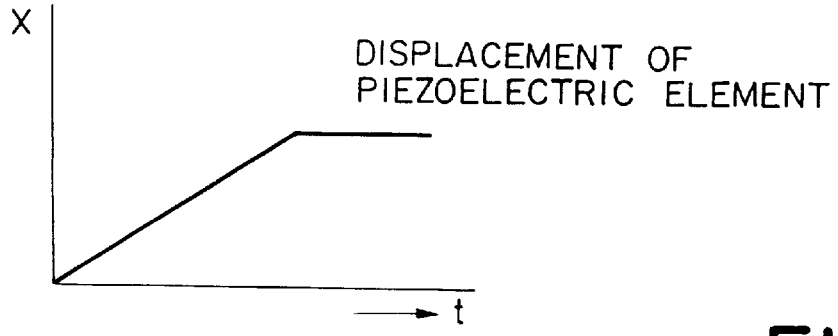
Figure 4C:
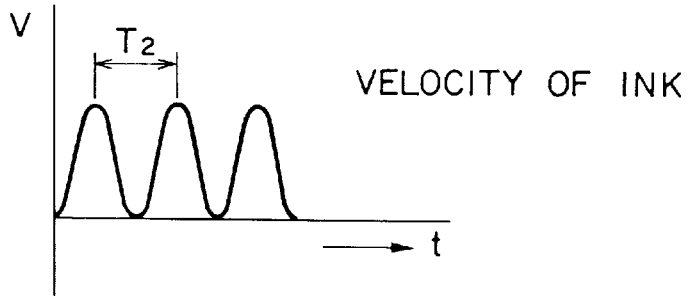

Referring to FIGS. 4A to 4C showing a second comparative example, if a constant velocity of the piezoelectric elements, as shown in FIG. 4A, is reached by application of a driving voltage having a long duration as compared to the natural period T1, displacement of the piezoelectric elements monotonically increases, as shown in FIG. 4B. The ink molecules inside the pressure chamber oscillates at the natural period T2 of the pressure chamber during the rise time, as shown in FIG. 4C, independently of the natural period T1 of the piezoelectric elements.

In general, if the rise time T3 is selected independently of T1 or T2, the velocity of the ink molecules at the nozzle chip has a residual oscillation. Accordingly, T1 and T2 should be selected such that T1=n·T2 or T2=n·T1 wherein n is a natural number, in order to select a preferred value for T3.

The present invention provides an ink Jet printer including a printing head having a natural period (or characteristic oscillation period) T1 of the piezoelectric elements and a natural period T2 of the pressure chamber in an ink jet printing head. T1 and T2 are selected such that T1=n·T2 or T2=n·T1 wherein n is a natural number. The natural period T2 of the pressure chamber may be called natural the period of the wave propagating along the ink inside the pressure, chamber. In this case, rise time T3 of the driving voltage should be selected at T3=m·T1 if T2=n·T1 or at T3=m·T2 if T1=n·T2 wherein m is a common multiple of n.

In an embodiment, if T1 and T2 are specifically selected wherein T1=2·T2, the rise time T3 of the driving voltage should be selected at T3=m·T2 wherein m is a an even number. On the other hand, if T2 is selected at T2=n·T1 wherein n is a natural number not lower than two, the rise time T3 should be selected at T3=m·T2 wherein m is a natural number.

FIGS. 5A, 5B, 5C and 5D are timing charts of driving voltage, displacement of piezoelectric elements, velocity thereof and velocity of ink droplets at the nozzle chip, respectively, in the ink jet printing head of FIG. 1 driven by a first embodiment of the method according to the present invention. In these drawings, the rise time T3, during which the drive voltage applied to the piezoelectric elements increases linearly, is selected at T3=2·T2 (namely, m=2) and T3=T1 (namely, Ti=2·T2 and n=2) wherein T2 and T1 represent the natural period of the pressure chamber and the natural period of the piezoelectric elements, respectively.

Figures 5A, 5B, 5C, 5D:
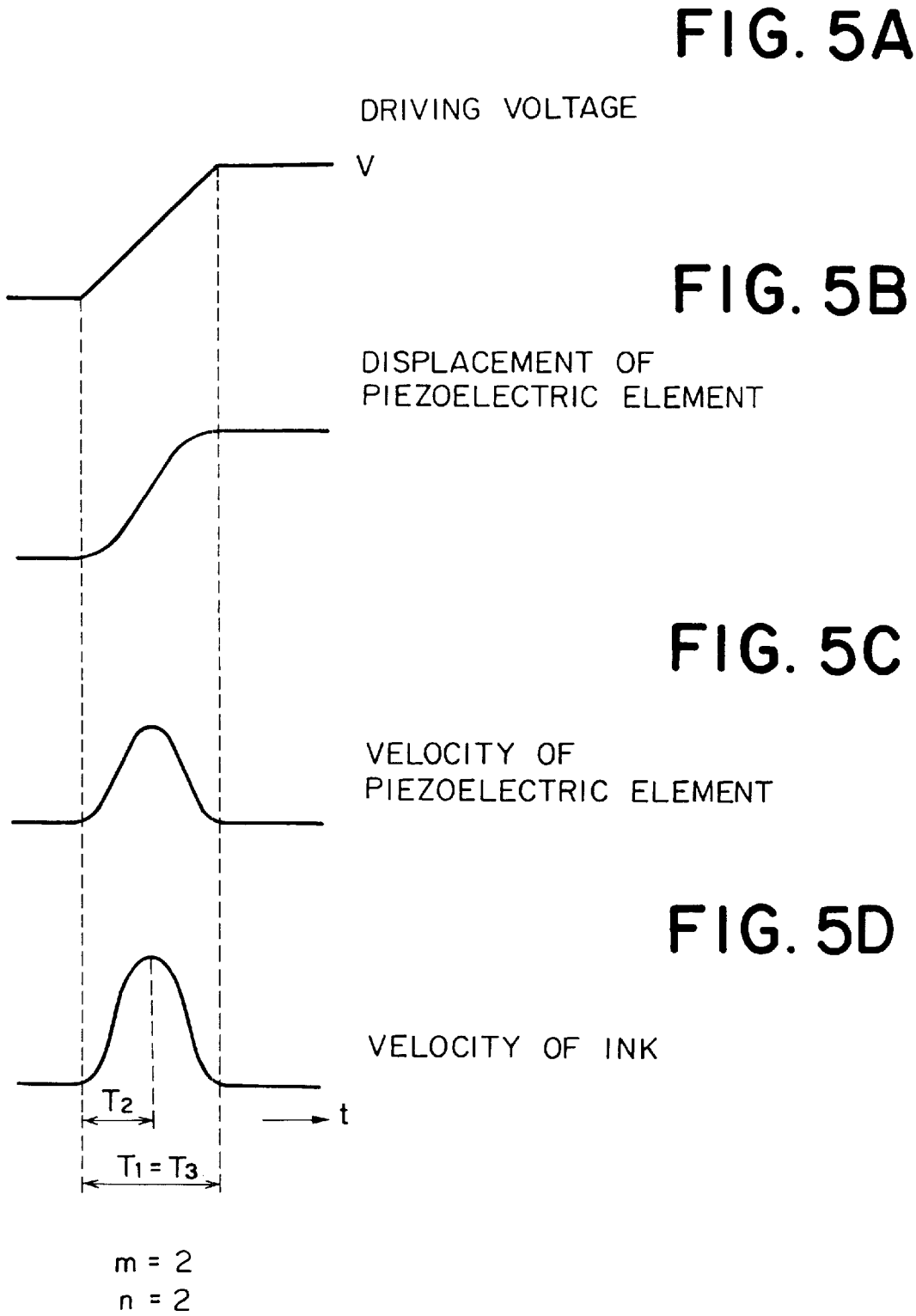
FIGS. 5A, 5B, 5C and 5D are timing charts of a supply voltage of piezoelectric elements, displacement thereof, velocity thereof and velocity of ink molecules at the nozzle chip, respectively, for showing a first embodiment of a driving method according to the present invention.
Figures 6A, 6B, 6C, 6D:
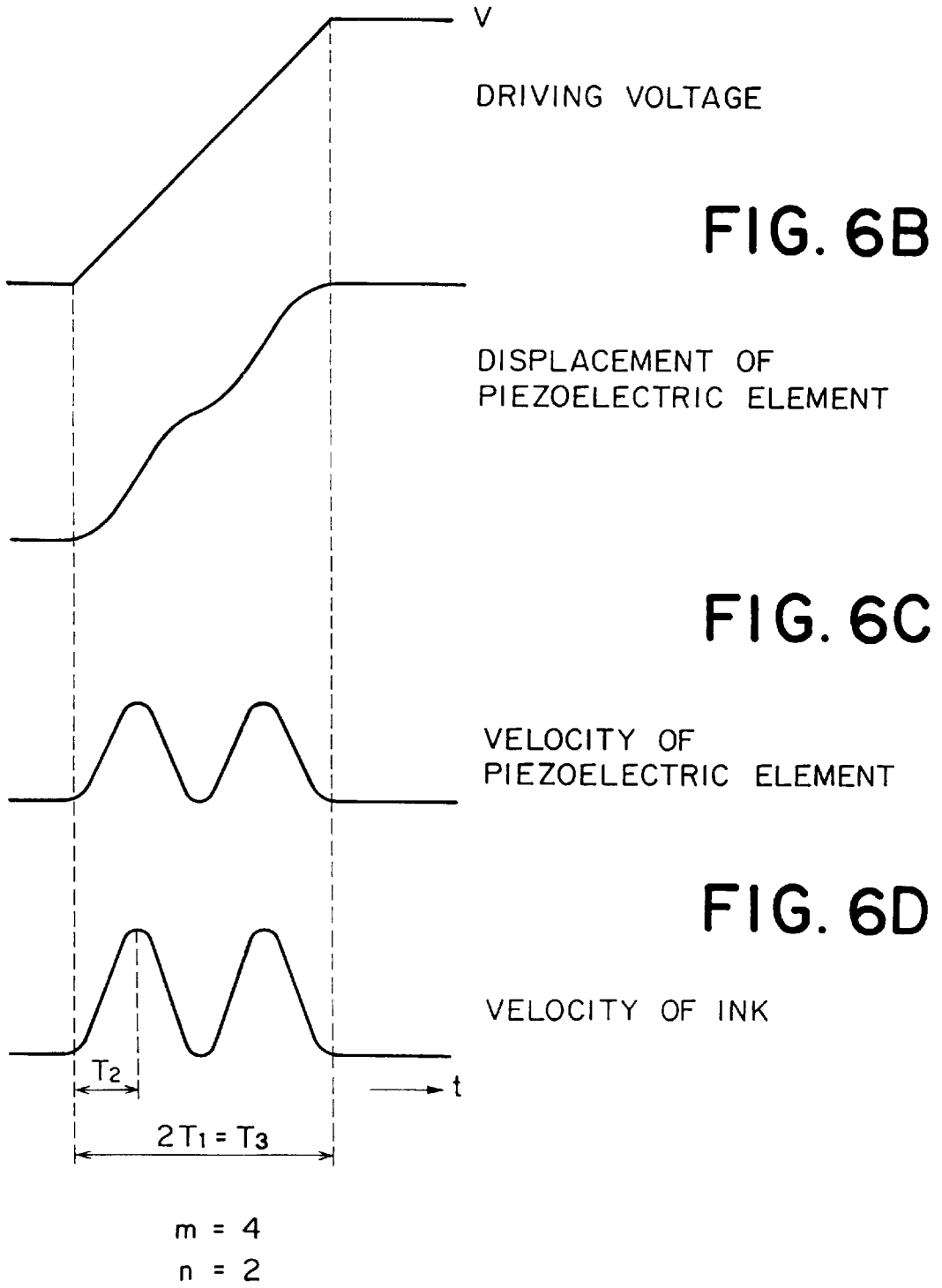
FIGS. 6A, 6B, 6C and 6D are timing charts of a supply voltage of piezoelectric elements, displacement thereof, velocity thereof and velocity of ink molecules at the nozzle chip, respectively, for showing a second embodiment of a driving method according to the present invention.

The rise time T3 of the driving voltage thus selected provides monotonically increasing displacement of the piezoelectric elements, as shown in FIG. 5B, a single cycle of the velocity of the piezoelectric elements, as shown in FIG. 5C, and a single cycle of the velocity of the ink molecules at the nozzle chip, as shown in FIG. 5D, each of the single cycles having a duration equal to the natural period T1 due to the resonance of the piezoelectric elements. As a result, a single ink main droplet is generated by the driving voltage without a satellite droplet, which is generally generated by a residual oscillation as described before. An ordinary printing can be performed by using the first embodiment.

FIGS. 6A, 6B, 6C and 6D show a second embodiment of the driving method, similarly to FIGS. 5A, 5B, 5C and 5D, respectively. In this embodiment, rise time T3 of the linearly increasing driving voltage is selected at T3=4·T2 (namely, m=4) and T3=2·T1 (namely, T1=2·T2 and n=2) while the final level V of the driving voltage is two times the final level shown in FIG. 5A. The rise time T3 thus selected provides the piezoelectric element with oscillation based on the natural period T1 of the piezoelectric elements and natural period T2 of the pressure chamber.

The rise time T3 generates two cycles of velocity of the ink molecules at the nozzle chip, the two cycles including respective maximal velocity equal to each other and having a duration of T1. The two cycles of the velocity will generate, however, a single ink droplet which has the size double the size of the droplet generated by the velocity shown in FIG. 5D. An ordinary printing can be performed by using the second embodiment.

In a preferred embodiment of the present invention, a gray scale level printing is performed by using the principle of a combination of the first embodiment in which the T3 is small and the second embodiment in which the T3 is large, thereby providing different sizes of the ink droplets. In detail, the final voltage level V of the driving voltage is controlled in accordance with a desired gray scale level. Further, the rise time T3 is controlled such that the ratio of the final voltage level V to the rise time T3 is selected at a constant. In other words, the rise angle of the driving voltage with respect to time is maintained constant for different final voltage levels. By this configuration, the velocity of the ink molecules at the nozzle chip can be maintained constant so that the landing positions of the ink droplets are substantially the same, while selecting different sizes of the ink droplet to attain a gradation sequence printing.

Figure 7A:
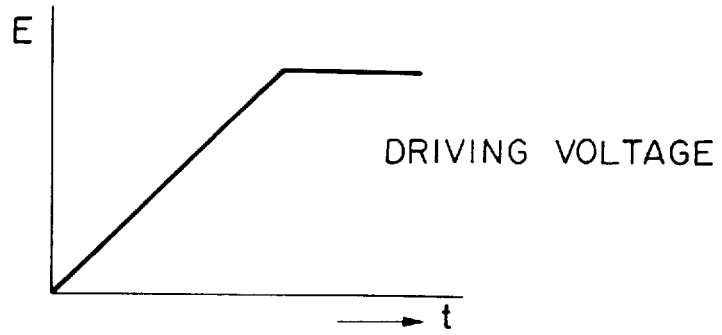
FIGS. 7A, 7B, 7C and 7D are timing charts of a supply voltage of piezoelectric elements, displacement thereof, velocity thereof and velocity of ink molecules at the nozzle chip, respectively, for showing a third embodiment of a driving method according to the present invention.
Figure 7B:
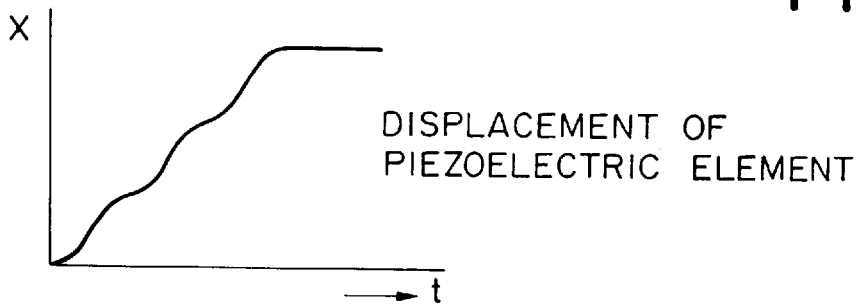
Figure 7C:
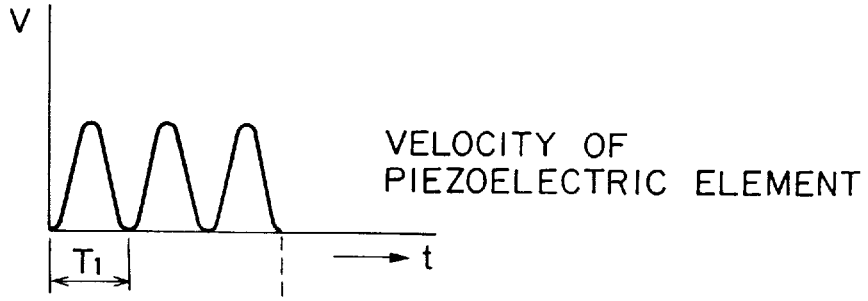
Figure 7D:
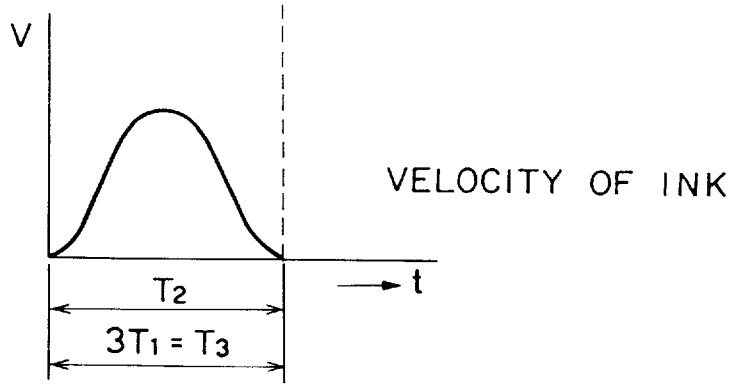

FIGS. 7A, 7B, 7C and 7D show a third embodiment of the driving method similarly to FIGS. 5A, 5B, 5C and 5D, respectively. In this embodiment, rise time T3 of the driving voltage is selected at T3=T2 (namely, m=1) and T3=3·T1 (namely, T2=3·T1 and n=3). The rise time T3 thus selected provides three cycles of the velocity of the piezoelectric elements in which the maximal value of the waveform of the velocity are equal to each other and each cycle has a duration T1, as shown in FIG. 7C. The rise time T3 also provides a single cycle of the velocity of the ink molecules at the nozzle chip, the single cycle having a duration T3=3·T1. In other words, by the configuration as described above, the velocity of the ink molecules has a single cycle based on the natural period T2 of the pressure chamber in spite of the three cycles of the piezoelectric elements which oscillate at the natural period thereof.

Since above embodiments are described only for examples, the present invention is not limited to such embodiments and it will be obvious for those skilled in the art that various modifications or alterations can be easily made based on the above embodiments within the scope of the present invention.

What is claimed is:

1. An ink jet printing head for discharging ink droplets having a substantially uniform velocity and without satellite ink droplets having low velocities from a nozzle, in order to print an image of increased image quality, said print head comprising:

an ink chamber, a plurality of pressure chambers having an inlet communicated with said ink chamber and said nozzle for discharging said ink droplets therethrough, a driving voltage;

a piezoelectric element, disposed for each of said plurality of pressure chambers, for pressurizing each of said plurality of pressure chambers upon application of said driving voltage, said piezoelectric element having a natural period T1 of oscillation, each of said plurality of pressure chambers having a natural period T2 for propagation of waves, wherein T1 and T2 are selected so as to satisfy one of the following equations:

$$T1=n\cdot T2$$

and $$T2=n\cdot T1$$

wherein n is a natural number not lower than two;

said driving voltage having a rise time T3, wherein T3 is selected so as to satisfy the following equation:

$$T3=mT2,$$

wherein m is a natural number; and wherein said ink droplets discharged from said nozzle have said substantially uniform velocity and satellite ink droplets with low velocities are prevented from degrading said image quality.

2. An ink jet printing head as defined in claim 1 wherein T1=2·T2.

3. An ink jet printing head as defined in claim 1 wherein T2=n3·T1.

4. A method for driving an ink jet printing head to discharge ink droplets having substantially uniform velocity and without satellite ink droplets having low velocities from a nozzle, in order to print an image of increased image quality, said print head comprising:

a pressure chamber having a natural period T2 for propagation of ink waves, and a piezoelectric element having a natural period T1 of oscillation, wherein T1 and T2 are selected so as to satisfy at least one of T1=n·T2 and T2=n·T1, wherein n is a natural number not lower than two, said method comprising the steps of:

applying a driving voltage to said piezoelectric element, said driving voltage having a rise time T3 which is substantially equal to m·T2, wherein m is a multiple of n;

pressurizing said pressure chamber; and discharging said ink droplets having said substantially uniform velocity from said pressure chamber such that satellite ink droplets with low velocities are prevented from degrading said image quality.

5. The method for driving an ink jet printing head as defined in claim 4, wherein the step of applying the driving voltage further comprises:

driving the voltage to a final voltage level such that the ratio of the final voltage level to said rise time T3 is maintained at a constant, and m is selected in accordance with a specified scale level.

6. The method for driving an ink jet printing head as defined in claim 4, wherein the step of applying the driving voltage further comprises:

driving the voltage to a final voltage level such that T1=n·T2 and m is an even number.

7. The method for driving an ink jet printing head as defined in claim 4, wherein the step of applying the driving voltage further comprises:

driving the voltage to a final voltage level such that T2=n·T1, n being a natural number not lower than two.

* * * * *

UNITED STATES PATENT AND TRADEMARK OFFICE

CERTIFICATE OF CORRECTION

PATENT NO. : 6,149,258
DATED : November 21, 2000
INVENTOR(S) : Shigeru Kimura

It is certified that error appears in the above-identified patent and that said Letters Patent is hereby corrected as shown below:

Column 2,
Line 4, delete "21/c" insert --2ℓ/c--;
Line 5, delete "i" insert --ℓ--;
Line 42, delete "depend" insert --depending--

Column 3,
Line 44, delete "dependently of: insert --depending on--

Column 7,
Line 5, delete "mT2" insert --m.T2--;
Line 15, delete "n3.Ta" insert --3.T1--

Column 8,
Line 21, delete "m" insert --n--.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*